United States Patent [19]

Rosa

[11] Patent Number: 4,638,605

[45] Date of Patent: Jan. 27, 1987

[54] MOUNTING MECHANISM FOR CONNECTING LIGHT BOX TO TELEPHONE ENCLOSURE

[75] Inventor: Frank Rosa, Brooklyn, N.Y.

[73] Assignee: Redyref-Pressed & Welded, Inc., Long Island City, N.Y.

[21] Appl. No.: 701,392

[22] Filed: Feb. 14, 1985

[51] Int. Cl.[4] ..... E04F 19/00

[52] U.S. Cl. ..... 52/28; 40/553; 248/220.2; 248/225.31; 248/494

[58] Field of Search ..... 52/28, 38; 248/220.2, 248/225.31, 231.4, 494, 489; 40/541, 553

[56] References Cited

U.S. PATENT DOCUMENTS

| | | | |
|---|---|---|---|
| 2,821,038 | 1/1958 | Gee | 52/28 X |
| 2,881,306 | 4/1959 | Sherron | 40/553 X |
| 3,005,277 | 10/1961 | Sherron | 52/38 X |
| 3,017,712 | 1/1962 | Sherron | 40/553 |
| 3,103,708 | 9/1963 | Pomeroy et al. | 52/28 X |
| 3,203,142 | 8/1965 | Narmore | 248/494 X |

*Primary Examiner*—Carl D. Friedman

*Attorney, Agent, or Firm*—Gottlieb, Rackman & Reisman

[57] ABSTRACT

A mounting mechanism for connecting a light box to a telephone enclosure includes a first bracket, a second bracket and an optional back plate. The device permits installation of a light box in the field by one individual working alone, using no tools other than a screwdriver.

7 Claims, 2 Drawing Figures

MOUNTING MECHANISM FOR CONNECTING LIGHT BOX TO TELEPHONE ENCLOSURE

Figure 1:
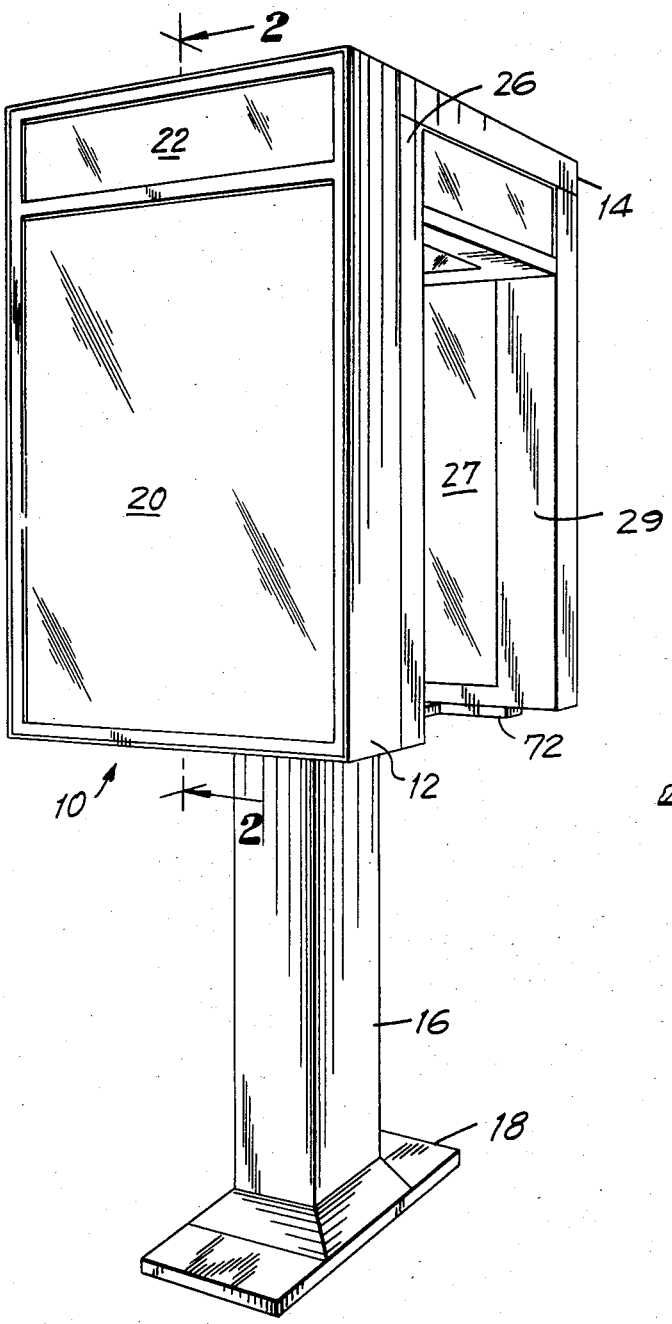

This invention relates to telephone booths, and more specifically, to an improved mechanism for mounting a light box to a telephone enclosure.

For many years, telephone communication has been made available to the public through the placement of coin-operated telephones on the streets, in public buildings, and in other public areas such as train stations and bus terminals. In order to shield the user from adverse weather conditions, provide illumination at night and insure some degree of privacy, such public telephones are usually housed in an enclosure which, in the past, was configured as a booth or stall accommodating the body of the user in either a standing or sitting position, and having a closable door.

In recent times, however, such telephone booths, especially those located on public streets, have been replaced by more modern, streamlined telephone kiosks, which are acoustical enclosures usually having only three walls and no door or entranceway. The three walls commonly extend upward from a height which is approximately level with an adult user's waist, to a height which is above the user's head, where the walls intersect with a flat roof under which the user can stand to use the telephone equipment. Such kiosks are usually mounted, either singly or in pairs, on one or more metal pedestals which are securely attached to the ground, and through which the telephone wires and other power lines pass.

More recently, it has become desireable to utilize the outer walls of such telephone kiosks to display printed and graphic information, usually for advertising purposes. In fact, it has become fairly commonplace for utility companies offering public telephone services to maximize revenue by renting or otherwise charging a fee for advertising space located on the outer walls of the enclosures which house public telephone equipment.

In order to accommodate this need, means for displaying advertising messages in this outdoor environment have evolved. At present, a preferred display device consists of a rectangular "light box," which contains some form of back lighting, and is adapted to accommodate a replacable advertising poster insert. Such display devices are usually flush-mounted to one or both side walls of the public telephone kiosks of the type described hereinabove.

In the past, light boxes have been mounted on to telephone kiosks in a conventional manner, that is, by bolting the light box to the side wall of the kiosk through holes drilled expressly for that purpose. This prior art mounting mechanism has the inherent disadvantage of requiring at least two persons to accomplish the installation. One person must lift the light box and retain it at or near the desired installation location, while a second person drills the necessary holes through the side wall of the telephone kiosk, passes the mounting bolts through the holes, and then performs a tightening operation. This must be done for at least two or three mounting bolts before enough support is obtained from the telephone kiosk to enable the first worker to let go of the light box. Moreover, this installation scheme requires the drilling of holes, and therefore requires the presence of electrical drilling equipment and a convenient source of power.

It is therefore an object of the present invention to provide a mounting mechanism for connecting a light box to a telephone enclosure which will enable the installation procedure to be accomplished by one person.

Another object of the present invention is to provide a mounting mechanism for connecting a light box to a telephone enclosure which does not require electrically powered equipment to install.

Briefly, in accordance with the principles of the present invention, a mounting mechanism for connecting a light box to a telephone enclosure includes a first bracket secured to the rear surface of the light box which is configured for mating engagement within an aperture in the side wall of the telephone enclosure, and a second bracket which is secured to the bottom surface of the light box and is configured for mating engagement with the lower portion of the side wall of the telephone enclosure. The mounting mechanism preferably also includes a back plate adapted to retain the first bracket and to provide additional security and a weathertight seal.

Figure 2:
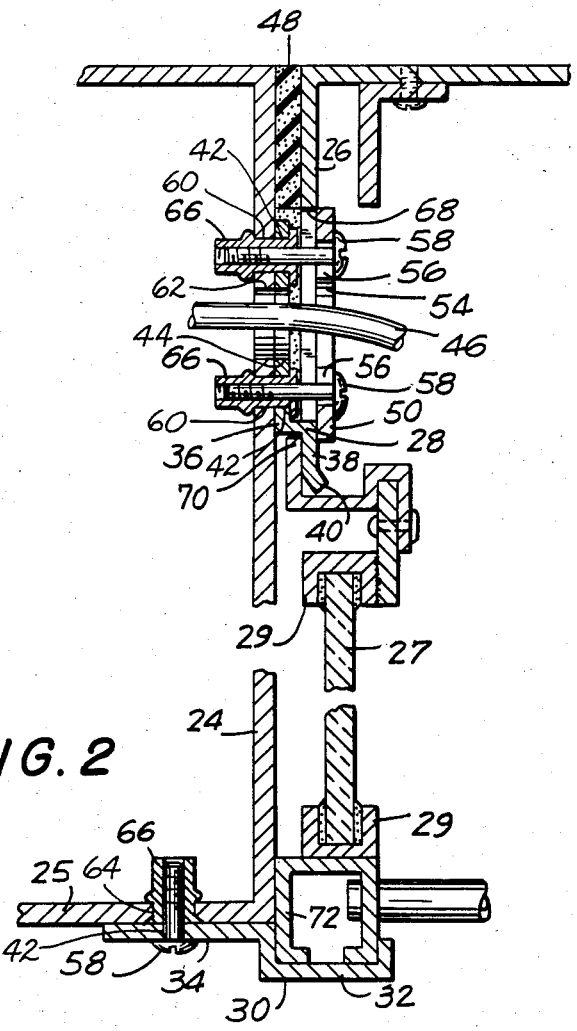

Further objects, features and advantages of the present invention will become more readily apparent from an examination of the following specification, when taken in conjunction with the drawings, wherein:

FIG. 1 is a perspective view of a telephone kiosk with a light box mounted thereto in accordance with a preferred embodiment of the present invention; and FIG. 2 is an enlarged, foreshortened, cross-sectional view, taken substantially along the lines 2—2 of FIG. 1.

Referring now to the drawings, and in particular to FIG. 1, a light box connected to a telephone kiosk, which is the environment for the present invention, is generally designated 10. For simplicity and ease of understanding, only one light box 12 is shown mounted on one side of a single telephone kiosk 14, although it is to be understood that another light box could be mounted to the far side (as shown in FIG. 1) of telephone kiosk 14, facing in the opposite direction, and that different configurations of telephone kiosks are possible, e.g., kiosks including double or multiple telephone units.

As shown in FIG. 1, telephone kiosk 14 is supported on a pedestal 16 which rests on a base 18. Pedestal 16 usually houses both the telephone lines which activate the telephone equipment (not shown), as well as conventional power lines, which provide electricity for lighting (not shown).

Light box 12, on its outer or display side, includes a lower display area 20 and an upper display area 22. In general, the upper display area may be used to display a conventional sign bearing the word "TELEPHONE" or "PHONE," to substitute for a similar sign (not shown) usually mounted on the side wall 26 of the telephone kiosk 14, but concealed when a light box 12 is mounted thereon. The primary focus of light box 12, however, is lower display area 20, wherein advertising material is displayed, usually by means of interchangeable placards or posters (not shown).

Referring now to FIG. 2 in addition to FIG. 1, light box 12 includes a rear wall 24 and a bottom wall 25, to which a preferred embodiment of the present invention is shown attached, permitting the light box 12 to be mounted directly onto the side wall 26 of telephone kiosk 14, adjacent to side glass 27 and side glass frame 29. Preferably, the mounting mechanism comprises an upper bracket 28 and a lower bracket 30. As shown best in FIG. 2, lower bracket 30 comprises a U-shaped channel 32 and a laterally-extending flange 34 which is preferably formed integrally with U-shaped channel 32. Upper bracket 28 is also an integrally-formed unit, comprising a flat plate 36, an angular flange 38 and a lip 40.

Both upper bracket 28 and lower bracket 30 are preferably fabricated of stainless steel, of a thickness ranging from 0.046875 inches to 0.125 inches, and most preferably from 0.0625 inches to 0.078125 inches, and may be as wide as, but are preferably slightly narrower than, light box 12. Lower backet 30 carries mounting holes 42, while upper bracket 28 carries mounting holes 42, all of which are adapted to receive mounting screws 58. Upper bracket 28 may also carry a larger aperture 44 to allow passage therethrough of electrical conduit 46, by which electrical power is conveyed from a source (not shown) within telephone kiosk 14 to the lights or other illuminating elements (not shown) mounted within light box 12.

As shown in FIG. 2, the mounting mechanism of the present invention also includes a gasket 48 which fits above and on either side of upper bracket 28. Gasket 48 may be of one-piece construction, or may consist of separate pieces. Preferably, gasket 48 is fabricated of cork, and most preferably is cut from a cork material which is about 0.0625 inches thick and is prefabricated with an adhesive backing. An acceptable material is available commercially from Cork Products Co. of New York, N.Y. Gasket 48 prevents moisture and dirt from entering the narrow gap between light box 12 and side wall 26 of telephone kiosk 14.

The mounting mechanism of the present invention also optionally includes a back plate 50, which carries mounting holes adapted to receive mounting screws (not shown), as well as a larger aperture 54. Aperture 54 allows electrical conduit 46 to pass through backplate 50, and has two extensions 56 adapted to accept mounting screws 58.

As shown in FIG. 2, rear wall 24 of light box 12 is provided with mounting holes 60 which can be aligned with mounting holes 42 of upper bracket 28, and also aligned with extensions 56 of back plate 50. In addition, rear wall 24 of light box 12 is provided with a larger aperture 62, which may be aligned with aperture 44 of upper bracket 28 and with aperture 54 of backplate 50, to allow the passage of electrical conduit 46. Bottom wall 25 of light box 12 is preferably provided with mounting holes 64, one of which is shown in FIG. 2, for attachment of lower bracket 30.

In use, the mounting mechanism of the present invention may be loosely attached to a light box 12 before the latter is transported to the installation site. As shown in FIG. 2, light box 12 is provided prior to shipment with threaded blind fasteners 66, which are adapted to fit within mounting holes 60 and 64, and are adapted to receive mounting screws 58. Fasteners of the type preferred for use with the present invention are available commercially from a variety of sources, including B.F. Goodrich Engineered Systems Company of Akron, Ohio, which markets such fasteners under the trademark RIVNUT. Upper bracket 28 and lower bracket 30 may be pre-mounted on light box 12 utilizing screws 58 which are not completely pulled up in fasteners 66. Preferably, gasket 48 is pre-mounted onto rear wall 24 of light box 12 by means of the adhesive.

The installation procedure may be accomplished by first removing the "TELEPHONE" or "PHONE" sign (not shown), which is usually mounted in a generally rectangular opening 68 in the side wall 26 of telephone kiosk 14 (see FIG. 2), thereby exposing a lip 70 on side wall 26. Light box 12 can then be elevated manually by any appropriate means, and "hung" on side wall 26 by fitting lip 40 and flange 38 of upper bracket 28 over, and then inside of, lip 70. Thereafter, the entire weight of light box 12 can be supported by side wall 26 of telephone kiosk 14, thereby freeing the worker to carry out the other operations necessary to complete the installation procedure.

Thereafter, the position of light box 12 may be adjusted slightly, so that it is substantially congruent with side wall 26 of telephone kiosk 14 (as shown in FIG. 1), and so that the bottom wall 25 of light box 12 is located substantially adjacent to the lower support frame 72 of telephone kiosk 14. The U-shaped channel 32 of lower bracket 34 is then arranged adjacent to and underneath lower support frame 72, as shown most clearly in FIG. 2.

After light box 12 is properly positioned, it may be secured in place by a tightening operation, for which the only tool necessary is a screwdriver. The premounted screws 58 may now be tightened to provide a secure attachment of light box 12 to telephone kiosk 14.

It is to be understood, however, that the tightening operation will not be necessary for upper bracket 28 if the optional back plate 50 is not used. In this configuration (not shown), the mounting screws 58 associated with upper bracket 28 can be completely tightened before light box 12 is transported to the field, thereby securely attaching upper bracket 28 to the rear wall 24 of light box 12 prior to installation. Thus, at the time of installation, only the mounting screws 58 associated with lower bracket 30 would require tightening, and light box 12 would then be attached to telephone kiosk 14 only along bottom wall 25, and would merely rest upon lip 70 of side wall 26. The use of back plate 50 is preferred, however, since the tightening operation of upper bracket 28 which is required when back plate 50 is used provides additional security for light box 12, and enables the making of a weathertight fit between light box 12 and telephone kiosk 14.

It may be seen from the foregoing that the embodiment described is by way of illustration and not of limitation, and that various changes in and other modifications of the construction, composition and arrangement of parts are possible in light of the above teachings. Accordingly, it is to be understood that other embodiments of this invention may be utilized without departing from the spirit and scope of the present invention, as set forth in the appended claims.

I claim:

1. A device for connecting a light box having a rear wall and a bottom wall to a telephone enclosure having a side wall with an opening therein and a lower edge, said device comprising a first bracket secured to said rear wall and having a projection adapted for mating engagement with said opening, and a second bracket secured to said bottom wall and having a channel adapted to engage said lower edge.

2. A device in accordance with claim 1 further including a back plate adapted for placement within said opening and for engagement with said first bracket, and fastening means to retain said back plate in adjacent relationship with said first bracket.

3. A device in accordance with claim 2 wherein said fastening means comprises a plurality of mounting screws, a plurality of blind threaded fasteners adapted to receive said mounting screws, and a plurality of mounting holes in said light box adapted to receive said fasteners.

4. A device in accordance with claim 3 further including sealing means secured between said rear wall of said light box and said side wall of said telephone enclosure to provide a weathertight seal.

5. A device in accordance with claim 4 wherein said sealing means comprises a gasket fabricated of cork having an adhesive backing and disposed adjacent to said first bracket.

6. A device in accordance with claim 5 wherein said first bracket and said second bracket are fabricated of stainless steel.

7. A device in accordance with claim 6 wherein said first bracket and said second bracket have a thickness in the range of from about 0.046875 inches to about 0.125 inches.

* * * * *